US011377767B2

(12) United States Patent
Ishikawa et al.

(10) Patent No.: US 11,377,767 B2
(45) Date of Patent: Jul. 5, 2022

(54) FEED DOG MOUNTING/UNMOUNTING MECHANISM AND SEWING MACHINE

(71) Applicant: JANOME SEWING MACHINE CO., LTD., Tokyo (JP)

(72) Inventors: Muneyuki Ishikawa, Tokyo (JP); Norihiro Suzuki, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 0 days.

(21) Appl. No.: 17/331,702

(22) Filed: May 27, 2021

(65) Prior Publication Data

US 2021/0372020 A1 Dec. 2, 2021

(30) Foreign Application Priority Data

Jun. 1, 2020 (JP) ..... JP2020-095361

(51) Int. Cl.
*D05B 73/12* (2006.01)
*D05B 27/24* (2006.01)

(52) U.S. Cl.
CPC ..... *D05B 73/12* (2013.01); *D05B 27/24* (2013.01)

(58) Field of Classification Search
CPC ..... D05B 73/12; D05B 27/24; D05B 27/00
USPC ..... 112/324, 240, 260
See application file for complete search history.

(56) References Cited

U.S. PATENT DOCUMENTS 1,899,816 A * 2/1933 Maier ..... D05B 27/02 112/323
2,882,846 A * 4/1959 Coates ..... D05B 27/02 112/324
2,893,337 A * 7/1959 Irmscher ..... D05B 27/02 112/323
3,922,980 A * 12/1975 Fulp ..... D05B 65/00 112/197
10,415,167 B2 * 9/2019 Fukuba ..... D05B 27/02
2003/0005871 A1 * 1/2003 Sadasue ..... D05B 27/02 112/197
2010/0212563 A1 * 8/2010 Mizuno ..... D05B 27/02 112/260
2012/0079974 A1 * 4/2012 Tseng ..... D05B 27/02 112/324
2016/0194797 A1 * 7/2016 Fukuba ..... D05B 29/12 112/240

(Continued)

FOREIGN PATENT DOCUMENTS

JP 6441084 B2 12/2018

*Primary Examiner* — Danny Worrell
(74) *Attorney, Agent, or Firm* — Nakanishi IP Associates, LLC

(57) ABSTRACT

In feed dog mounting/unmounting mechanism, lever is slidably provided to feed base in the front-rear direction, and is forced backward by a lever force-applying spring. Upon sliding lever rearward, fixing target portion of feed dog 22 is fixedly held by base-side fixing portion of feed base and lever-side fixing portion of lever arranged in the front-rear direction. Stopper is provided to feed base so as to be movable in the upper-lower direction, and holds lever. When feed dog is mounted, stopper is pressed downward by feed dog, which moves stopper so as to allow lever to slide. With this, lever is slid due to force applied by the lever force-applying spring, thereby allowing fixing target portion to be held, interposed between base-side fixing portion and lever-side fixing portion.

8 Claims, 13 Drawing Sheets

(56) References Cited

U.S. PATENT DOCUMENTS

| | | | | |
|---|---|---|---|---|
| 2018/0080156 | A1* | 3/2018 | Nakajima | D05B 69/36 |
| 2021/0372020 | A1* | 12/2021 | Ishikawa | D05B 27/02 |

* cited by examiner

FEED DOG MOUNTING/UNMOUNTING MECHANISM AND SEWING MACHINE

BACKGROUND OF THE INVENTION

1. Field of the Invention

The present invention relates to a feed dog mounting/unmounting mechanism and a sewing machine provided with the mounting/unmounting mechanism.

2. Description of the Related Art

In a sewing machine described in Patent document 1 listed below, a feed dog is configured such that it can be detachably mounted on a feed base. Specifically, the feed base includes a mounting portion. The mounting portion is configured including a first receiving face, a second receiving face, and a pressing member configured as a plate spring. Furthermore, the feed dog includes a cam portion. With such an arrangement, when the cam portion is pressed downward after it is inserted into a gap between the first receiving face and the second receiving face, the shape of the pressing member is elastically changed by the cam portion. After the completion of the step in which the cam portion is pushed in, the pressing member presses the cam portion toward the first receiving face and the second receiving face, thereby mounting the cam portion on the mounting portion. This allows the feed dog to be detachably mounted on the feed base.

RELATED ART DOCUMENTS

Patent Documents

Patent Document 1
Japanese Patent No. 6,441,084

SUMMARY OF THE INVENTION

Disclosure of the Invention

Problem to be Solved by the Invention

With this arrangement, in a state in which the feed dog is mounted, it is necessary to maintain the mounting state of the feed dog by the pressing force applied by the pressing member. Accordingly, the pressing force to be provided by the pressing member is designed to be relatively high. On the other hand, when mounting the feed dog, there is a need to mount the cam portion on the mounting portion in a state in which the shape of the pressing member is elastically changed by the cam portion. That is to say, there is a need to mount the cam portion on the mounting portion against the relatively high pressing force provided by the pressing member. This leads to an increased burden on the operator. Thus, there is room for further improvement from the viewpoint of providing improved operating efficiency in the mounting of the feed dog.

In consideration of the above-described facts, it is a purpose of the present invention to provide a feed dog mounting/unmounting mechanism and a sewing machine that provides improved operating efficiency in the mounting of the feed dog.

Means to Solve the Problem

At least one embodiment of the present invention proposes a feed dog mounting/unmounting mechanism. The feed dog mounting/unmounting mechanism includes: a feed base configured to perform a feeding operation; a feed dog detachably mounted on the feed base and having a fixing target portion; a first fixing portion arranged on the feed base and configured to fix the fixing target portion; a lever slidably provided on the feed base and having a second fixing portion configured such that, when the lever is slid toward one side in a sliding direction from an initial position so as to be set to a fixed position, the fixing target portion is fixedly held such that it is interposed between the first fixing portion and the second fixing portion; a lever force-applying member configured to apply a force to the lever toward one direction side in the sliding direction; and a stopper movably provided on the feed base and configured to hold the lever at the initial position and such that, when it is pressed downward by the feed dog when the feed dog is mounted, the stopper is moved so as to allow the lever to slide.

At least one embodiment of the present invention also proposes the feed dog mounting/unmounting mechanism. The stopper is configured such that it can be moved between a lever holding position at which the lever is held at the initial position and a pressed position at which the stopper is pressed by the feed dog. The feed base is provided with a stopper force-applying member. The stopper force-applying member applies a force to the stopper toward the lever holding position side.

At least one embodiment of the present invention also proposes the feed dog mounting/unmounting mechanism. A lever-side holder face is formed in the lever. A feed base-side holder face is formed in the feed base such that it faces the lever-side holder face in the sliding direction. A gap is formed between the lever-side holder face and the feed base-side holder face at the fixed position.

At least one embodiment of the present invention also proposes the feed dog mounting/unmounting mechanism. The feed base is configured including: a feed base main body that forms a lower portion of the feed base; and a feed dog base that forms an upper portion of the feed base, and that is provided with the first fixing portion. The lever is slidably provided between the feed base main body and the feed dog base. The feed dog is mounted on the feed dog base from the upper side.

At least one embodiment of the present invention also proposes the feed dog mounting/unmounting mechanism. A stopper housing portion having an opening that faces the upper side is formed in the feed dog main body for housing the stopper and the stopper force-applying member. When the stopper is set to the lever holding position, a part of the stopper is arranged such that it protrudes toward the upper side from the stopper housing portion and such that it is in contact with the lever at the initial position.

At least one embodiment of the present invention also proposes the feed dog mounting/unmounting mechanism. The first fixing portion has a first fixing face that is inclined upward as it becomes closer to the other side in the sliding direction of the lever. The second fixing portion has a second fixing face that is inclined upward as it becomes closer to the one side in the sliding direction of the lever. The feed dog is held such that it is interposed between the first fixing face and the second fixing face.

At least one embodiment of the present invention also proposes the feed dog mounting/unmounting mechanism. The feed dog is configured including: a main body portion to be mounted on the feed dog base; and a protrusion portion configured such that it protrudes toward the lower side from the main body portion and such that it presses the stopper downward when the feed dog is mounted.

At least one embodiment of the present invention proposes a sewing machine including the feed dog mounting/unmounting mechanism having the above-described configuration.

Advantage of the Present Invention

With one or more embodiments of the present invention, this provides improved operating efficiency in the mounting of the feed dog.

DESCRIPTION OF THE PREFERRED EMBODIMENTS

Figure 1:
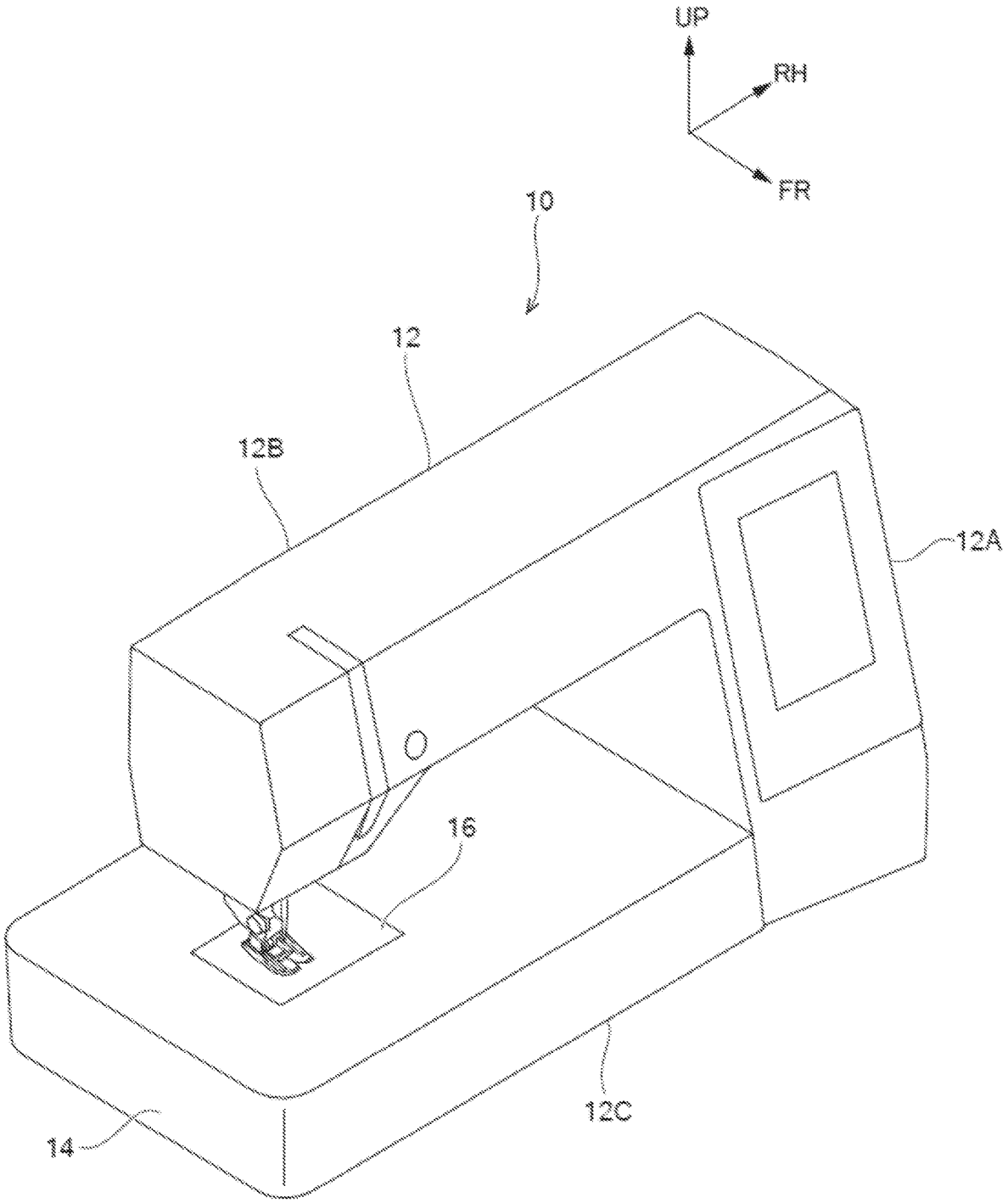
FIG. 1 is a perspective view showing a sewing machine employing a feed dog mounting/unmounting mechanism according to the present embodiment as viewed from the diagonally left-front side.
Figure 2:
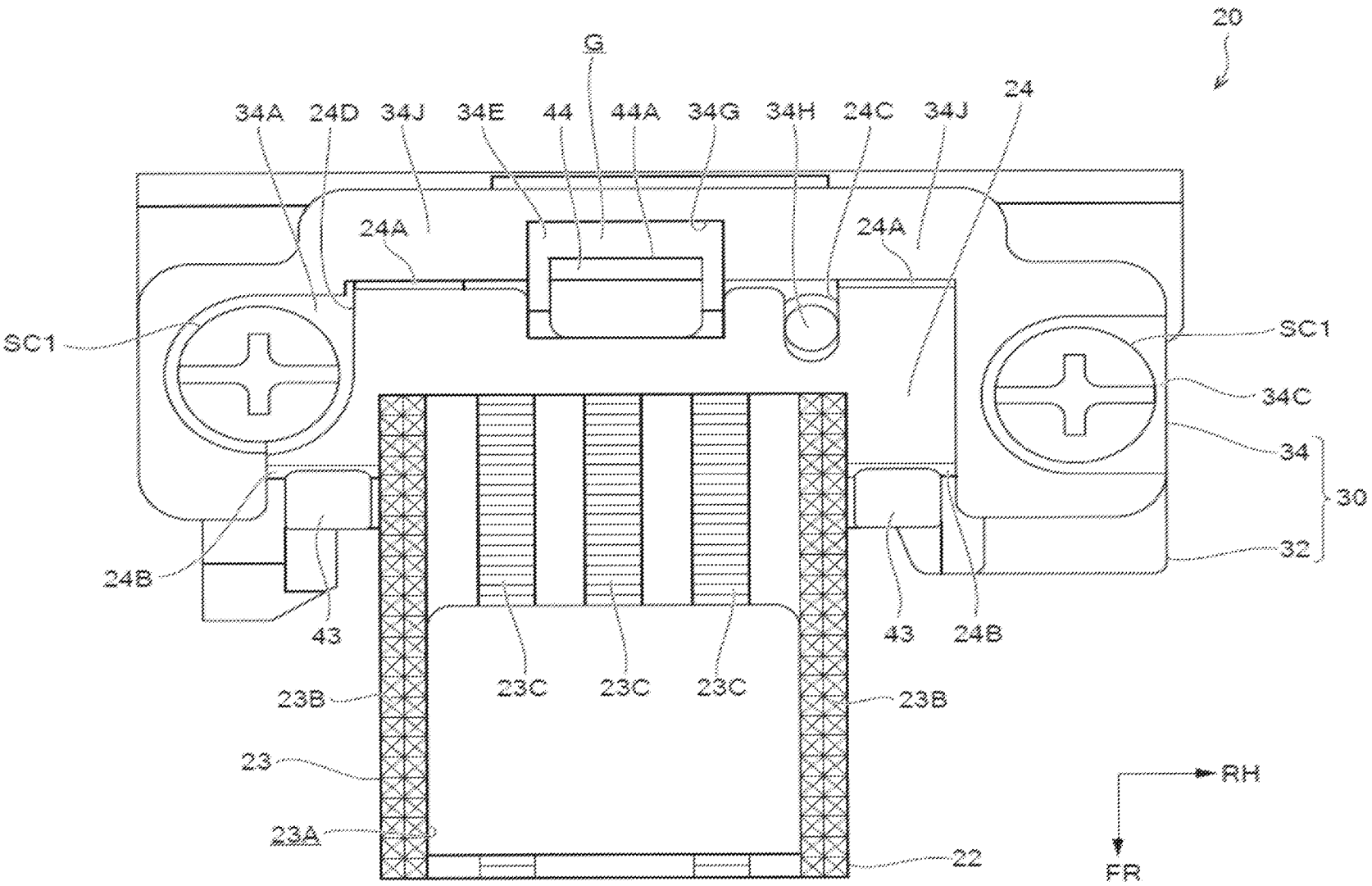
FIG. 2 is a plan view showing the feed dog mounting/unmounting mechanism according to the present embodiment as viewed from the upper side.
Figure 3:
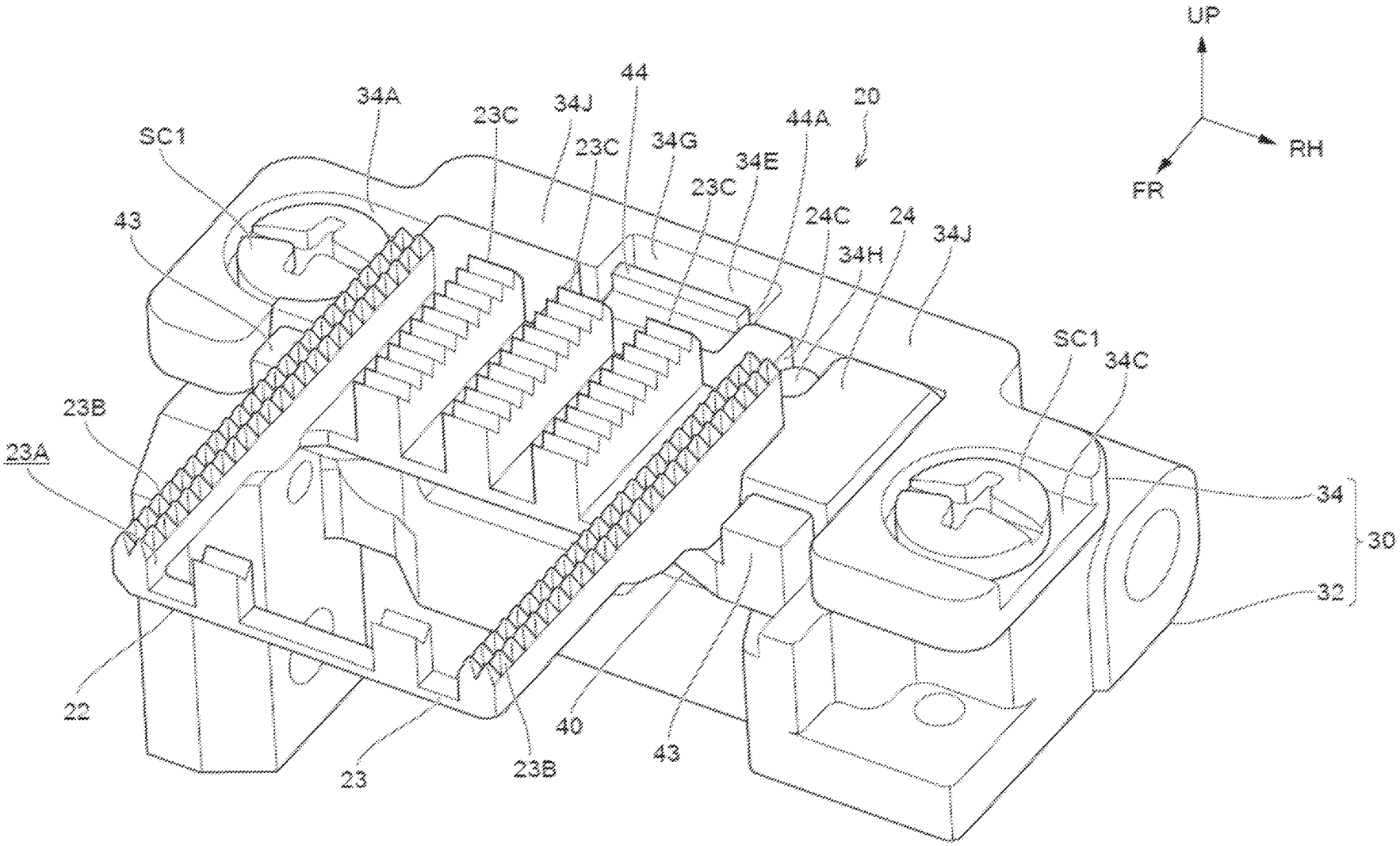
FIG. 3 is a perspective view showing the feed dog mounting/unmounting mechanism shown in FIG. 2 as viewed from the diagonally right-front side.

Description will be made with reference to the drawings regarding a sewing machine 10 employing a feed dog mounting/unmounting mechanism 20 according to the present embodiment. It should be noted that, in the drawings, which are shown as appropriate, the arrow UP indicates the upper side of the sewing machine 10, the arrow FR indicates the front side thereof, and the arrow RH indicates the right side thereof (one side in the width direction). The directions used in the following description, i.e., the upper-lower direction, the front-rear direction, and the left-right direction, represent the upper and lower, front and rear, and left and right directions of the sewing machine 10.

As shown in FIG. 1, the sewing machine 10 includes a sewing machine main body 12. In a front view as viewed from the front side, the sewing machine main body 12 is configured in an approximately U-shaped structure having an opening that faces the left side. Specifically, the sewing machine main body 12 is configured including a pillar portion 12A that forms the right end portion of the sewing machine main body 12 such that it extends in the upper-lower direction, an arm portion 12B configured such that it extends toward the left side from the upper end portion of the pillar portion 12A, and a bed portion 12C configured such that it extends toward the left side from the lower end portion of the pillar portion 12A. Furthermore, the sewing machine main body 12 is provided with a framework (not shown) as an internal structure that that forms a skeleton of the sewing machine main body 12. The framework is covered by a cover 14 that forms a housing of the sewing machine main body 12.

A needle plate 16 is detachably provided on an upper-left portion of the bed portion 12C. The needle plate 16 is configured in an approximately rectangular plate shape with the upper-lower direction as its thickness direction. Furthermore, a feed dog mounting/unmounting mechanism 20 (not shown in FIG. 1) is provided as an internal component of the bed portion 12C below the needle plate 16. With such an arrangement, when the sewing machine 10 is operated, a sewing target mounted on the upper side of the needle plate 16 is fed in the front-rear direction by the feed dog 22 mounted on the feed dog mounting/unmounting mechanism 20.

As shown in FIGS. 2 through 6, the feedback mounting/unmounting mechanism 20 is configured including a feed dog 22, a feed base 30, a lever 40, a lever force-applying spring 50 configured as a "lever force-applying member", a stopper 60, and a stopper force-applying spring 70 configured as a "stopper force-applying member". Description will be made below regarding each component of the feed dog mounting/unmounting mechanism 20.

Regarding the Feed Dog 20

The feed dog 22 is configured including a feed dog main body portion 23 configured as a "main body portion", and a fixing target portion 24. The feed dog main body portion 23 is configured in an approximately rectangular plate shape with the upper-lower direction as its thickness direction. A through hole 23A having an approximately rectangular shape is formed as a through hole in a front portion of the feed dog main body portion 23. Multiple tooth portions (configured in the form of five lines in the present embodiment) are formed in an upper end portion of the feed dog main body 23 such that they extend in the front-rear direction and such that they are arranged side by side in the left-right direction. Specifically, the feed dog main body portion 23 includes a pair of left and right first tooth portions 23B arranged in both end portions of the feed dog main body 23 in the left-right direction, three second tooth portions arranged between the pair of the left and right first tooth portions 23B on the rear side of the through hole 23A, and two third tooth portions 23C arranged on the front side of the through hole 23A. Furthermore, multiple teeth are formed on the upper face of each of the first tooth portions 23B and the second tooth portions 23C.

Furthermore, the feed dog main body portion 23 is configured such that the lower face of its rear end portion is one step lower toward the lower side as compared with the lower face of its front end portion. A restricting recess portion 23D (see FIG. 6) is formed in the lower face of the rear end portion of the feed dog main body portion 23 such that it is positioned in a central position in the left-right direction and such that its opening faces the lower side. The restricting recess portion 23D is configured in an approximately rectangular shape with the left-right direction as its longitudinal direction as viewed from the lower side.

The fixing target portion 24 is configured in an approximately U-shaped plate shape having an opening that faces the front side with the upper-lower direction as its thickness direction. The fixing target portion 24 is connected to a lower portion of the outer circumferential face in the rear end portion of the feed dog main body portion 23. The fixing target portion 24 is configured such that it protrudes outward in the left-right direction from the feed dog main body portion 23. Furthermore, the fixing target portion 24 is configured such that it protrudes toward the rear side. That is to say, the fixing target portion 24 forms the rear end portion of the feed dog 22 and both end portions thereof in the left-right direction. The fixing target portion 24 is arranged such that its lower face is positioned on the same plane as the lower face of the rear end portion of the feed dog main body portion 23.

A pair of left and right first fixing target faces 24A are formed in the rear face of the fixing target portion 24. In a side view, the first fixing target face 24 has a slope that is inclined upward in a linear manner as it becomes closer to the front side. Furthermore, a pair of second left and right fixing target faces 24B are formed in the front face of the fixing target portion 24 (specifically, a front face of a portion of the fixing target portion 24 configured such that it protrudes outward from the feed dog main body portion 23 in the left-right direction). The second fixing target face 24B is configured to have a slope that is inclined upward in a linear manner as it becomes closer to the rear side in a side view. That is to say, the first fixing target face 24A and the second fixing target face 24B are each configured as a flat sloping face.

Furthermore, a positioning groove 24C is formed in a right-side portion of the fixing target portion 24. The positioning groove 24C is configured such that it extends in the front-rear direction and such that it has an opening that faces the rear side and that is configured as a through hole passing through in the upper-lower direction. Furthermore, a notch portion 24D is formed in a left-end portion of the fixing target portion 24. In a plan view, the notch portion 24D is configured to have an opening that faces the left side and the rear side.

Regarding the Feed Base 30

The feed base 30 is configured as a base on which the feed dog 22 is to be mounted. The feed base 30 is configured including a base 32 configured as a "feed base main body" that forms a lower portion of the feed base 30 and a feed dog base 34 that forms an upper portion of the feed base 30.

Regarding the Base 32

Figure 4:
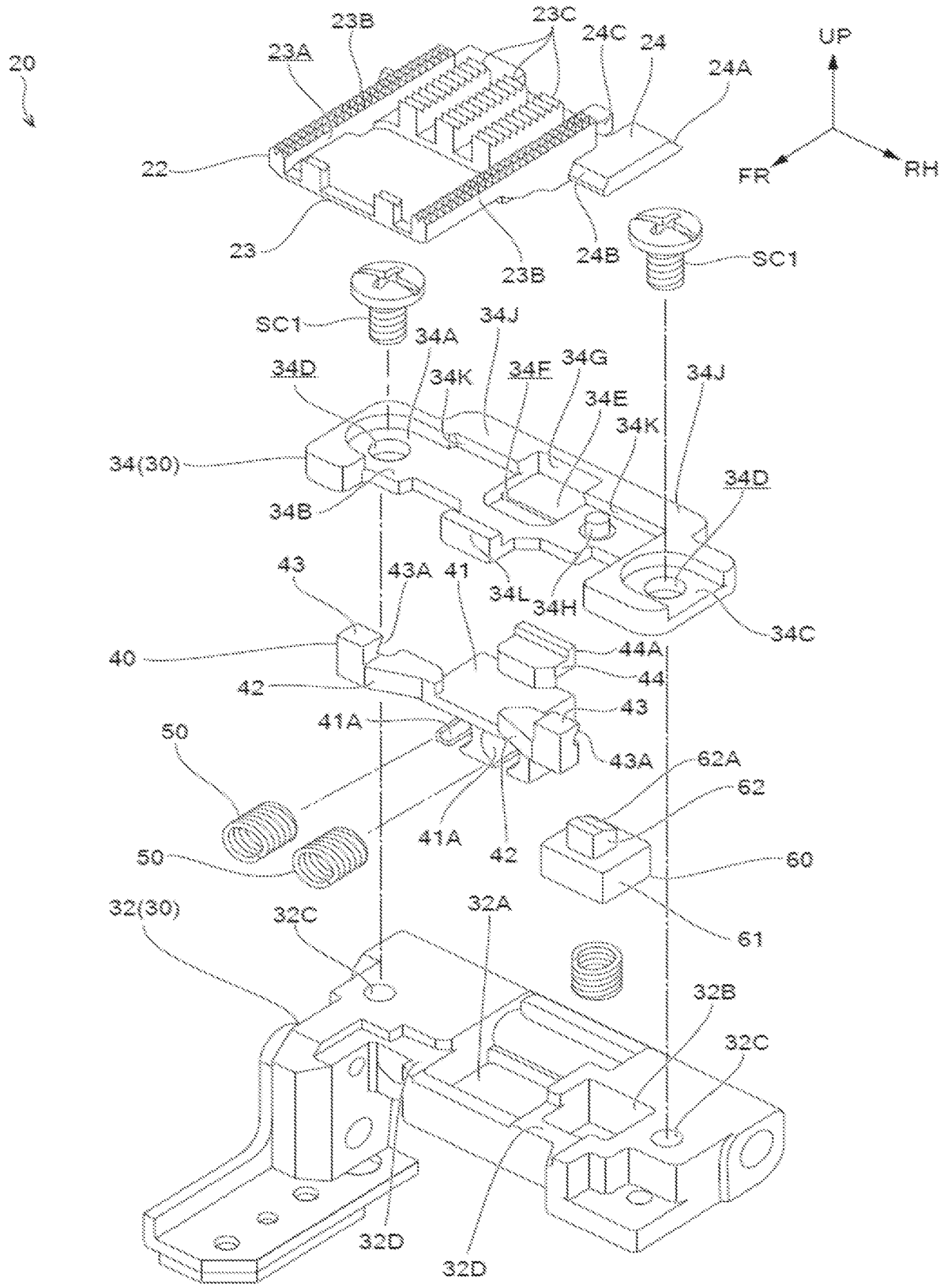
FIG. 4 is an exploded perspective view showing the feed dog mounting/unmounting mechanism shown in FIG. 3.

As shown in FIG. 4, the base 32 is coupled to a feed mechanism (not shown) provided in the interior of the bed portion 12C of the sewing machine 10. With such an arrangement, when the sewing machine 10 is operated, the base 32 (i.e., feed base 30) is configured to perform a feeding operation.

The base 32 is configured in an approximately rectangular block shape with the upper-lower direction as its thickness direction and with the left-right direction as its longitudinal direction. A lever housing portion 32A is formed in a central portion of the base 32 in the left-right direction so as to house a part of a lever 40 described later. The lever housing portion 32A is configured in a recessed shape having an opening that faces the upper side and in an approximately rectangular shape in a plan view. A stopper housing portion 32B is formed in the base 32 such that it is positioned on the right side of the lever housing portion 32A so as to house a stopper main body 61 of a stopper 60 described later. The stopper housing portion 32B is configured in a recessed shape having an opening that faces the upper side and in an approximately rectangular shape in a plan view. Furthermore, a pair of left and right screw portions 32C are formed in both end portions, i.e., the left and right end portions of the base 32. Each screw portion 32C is configured in a recessed shape having an opening that faces the upper side. A female screw thread is formed in the inner circumferential face of each screw portion 32C.

Furthermore, a pair of left and right step faces 32D are formed in the front end portion of the upper face of the base 32 such that they are positioned on the outer sides of the lever housing portion 32A in the left-right direction. Each step face 32D is arranged at a position that is one step lower than the upper face of the base 32. Furthermore, the right-side step face 32D is arranged adjacent to the front side of the stopper housing portion 32B. The front face of the upper end portion of the stopper housing portion 32B is notched by the step face 32D.

Regarding the Feed Dog Base 34

The feed dog base 34 is configured in an approximately rectangular plate shape with the upper-lower direction as its thickness direction and with the left-right direction as its longitudinal direction. The feed dog base 34 is arranged on the upper side of the base 32. A feed dog housing portion 34A is formed in the feed dog base 34 so as to house the fixing target portion 24 of the feed dog 22 described above. The feed dog housing portion 34A is configured in a recessed shape having an opening that faces the upper side, and such that it extends in the left-right direction. The bottom face of the feed dog housing portion 34A is configured as a mounting face 34B. The mounting face 34B is configured along a plane that is orthogonal to the upper-lower direction. Furthermore, a counterbored portion 34C is formed in the right-end portion of the feed dog base 34 such that it has an opening that faces the upper side and the right side. Moreover, a cylindrical fixing hole 34D is formed as a through hole in each of the left end portion and the counterbored portion 34C of the feed dog housing portion 34A such that they match the screw portions 32C of the base 32. With such an arrangement, a screw SC1 is inserted into each fixing hole 34D from the upper side and is screwed into the screw portion 32C, thereby fixedly coupling the feed dog 34 to the base 32.

A holder housing portion 34E is formed in a central portion of the feed dog base 34 in the left-right direction so as to house a lever-side holder portion 44 of the lever described later. The holder housing portion 34E is configured in a recessed shape having an opening that faces the upper side, and in an approximately rectangular shape in a plan view. The lower face of the holder housing portion 34E is arranged so as to be lower than the mounting face 34B. Furthermore, a hole portion 34F is formed in a front portion of the holder housing portion 34E in the form of a through hole having an approximately rectangular opening passing through in the upper-lower direction. Moreover, the rear face of the holder housing portion 34E is configured as a feed base-side holder face 34G.

A positioning boss 34H is provided to a right-side portion of the feed dog housing portion 34A such that it is positioned corresponding to the positioning groove 24C of the feed dog 22. The positioning boss 34H is configured in an approximately cylindrical shape with the upper-lower direction as its axial direction, and such that it protrudes from the mounting face 34B toward the upper side. With such an arrangement, in a state in which the feed dog 22 is fixedly mounted on the feed base 30, the positioning boss 34H is designed such that it is inserted into the positioning groove 24C so as to determine the relative position of the feed dog 22 with respect to the feed dog base 34 in the left-right direction.

Furthermore, a pair of outer-side portions in the left-right direction of the holder housing portion 34E formed in the rear end portion of the feed dog base 34 are configured as base-side fixing portions 34J configured as a pair of left and right "first fixing portions". That is to say, the base-side fixing portions 34J are arranged adjacent to the rear side of the feed dog housing portion 34A. Furthermore, each base-side fixing portion 34J is configured such that it protrudes upward with respect to the mounting face 34B, and such that its front face is configured as a rear face of the feed dog housing portion 34A. The front face of each base-side fixing portion 34J is configured as a base-side fixing face 34K configured as a "first fixing face". Each base-side fixing face 34K is configured as a slope that is inclined upward in a linear manner as it becomes closer to the front side in a side view. That is to say, the base-side fixing face 34K is configured as a flat sloping face.

With such an arrangement, in a state in which the feed dog 22 is fixedly mounted, the first fixing target face 24A of the fixing target portion 24 formed in the feed dog 22 is arranged adjacent to the front side of the base-side fixing face 34K such that the first fixing target face 24A comes in contact with the base-side fixing face 34K. With this arrangement, the base-side fixing face 34K and the first fixing target face 24A are engaged with each other so as to restrict the movement of the fixing target portion 24 toward the rear side and the upper side in the fixed state. Furthermore, in a side view, the slope angle of the base-side fixing face 34K in the front-rear direction is designed to be slightly smaller than that of the first fixing target face 24A of the fixing target portion 24 in the front-rear direction. Accordingly, in a state in which the first fixing target face 24A and the base-side fixing face 34K come in contact with each other, such an arrangement provides line contact between them instead of plane contact. Specifically, such an arrangement is designed such that the upper end portion of the base-side fixing face 34K comes in contact with the first fixing target face 24A.

Furthermore, a restricting protrusion 34L (see FIGS. 4 and 6) is provided to a central portion of the front end portion of the feed dog base 34 in the left-right direction such that it protrudes upward. The restricting protrusion 34L is configured in an approximately rectangular shape with the left-right direction as its longitudinal direction. With such an arrangement, in the state in which the feed dog 22 is fixedly mounted, the restricting protrusion 34L is inserted into an internal space formed in the restricting recess portion 23D of the feed dog 22. Specifically, with such an arrangement, the restricting protrusion 34L is inserted into the interior of the restricting recess portion 23D of the feed dog 22 such that no gap is formed between the rear face of the restricting protrusion 34L and the rear face of the restricting recess portion 23D in the front-rear direction. Such an arrangement restricts the movement of the feed dog 22 toward the front side with respect to the feed dog base 34.

Regarding the Lever 40

Figure 6A:
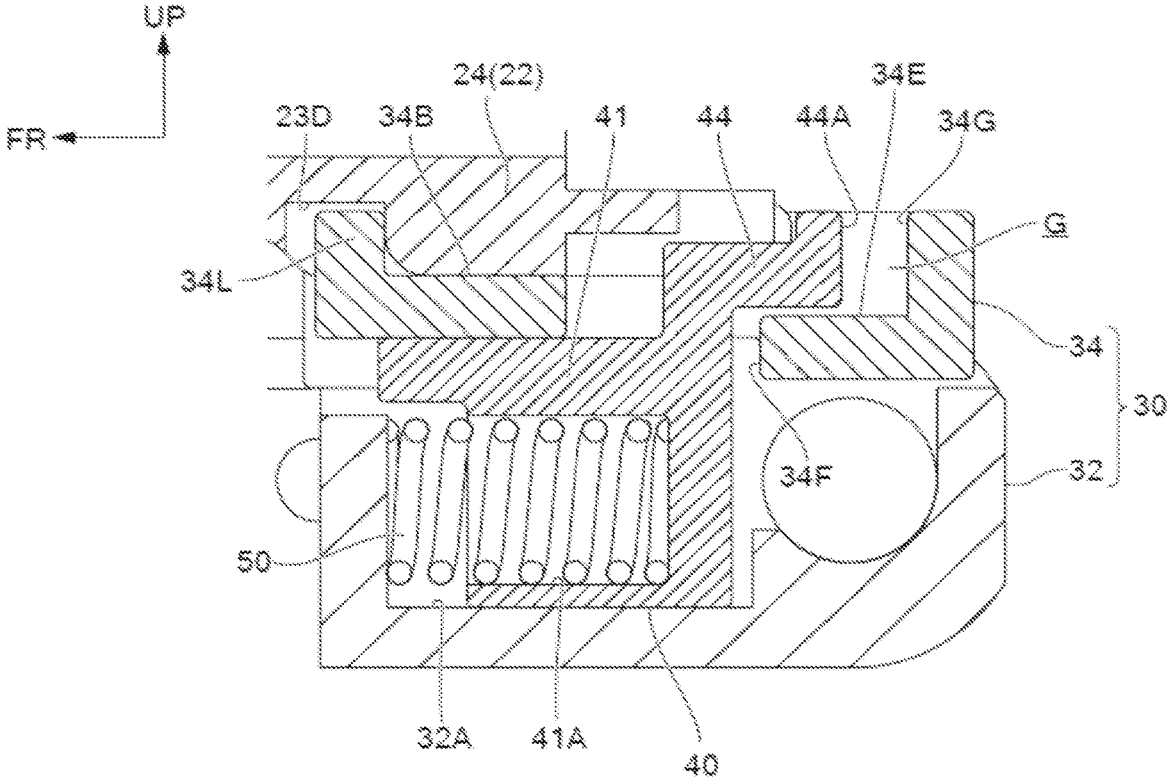
FIG. 6A is a cross-sectional diagram showing a state in which the lever main body is housed in the lever housing portion when the lever is set to the fixed position shown in FIG. 4.
Figure 6B:
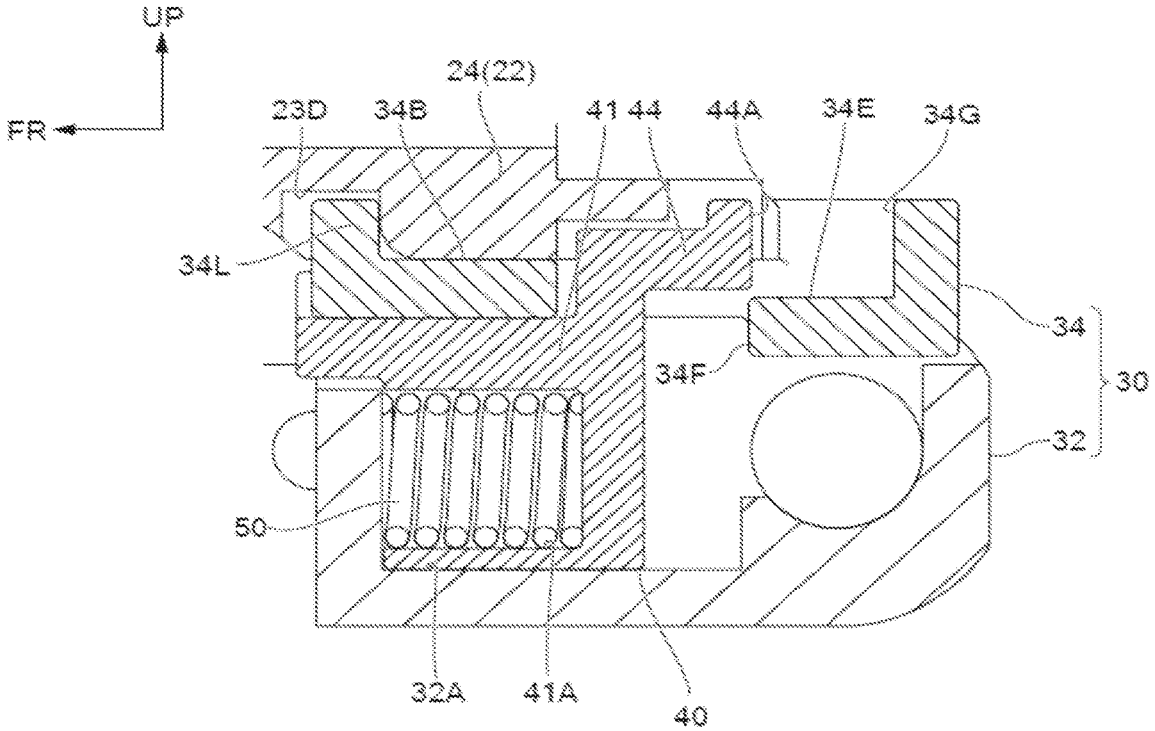
FIG. 6B is a cross-sectional diagram showing a state in which the lever is slid frontward from the fixed position and is set to an initial position.

As also shown in FIGS. 6A and 6B, the lever 40 includes a lever main body 41. The lever main body 41 is configured in an approximately rectangular block shape. With such an arrangement, the lever main body 41 is housed within the lever housing portion 32A of the base 32 such that it can be slid in the front-rear direction. Specifically, the lever 40 is configured such that it can be slid between an initial position (position shown in FIG. 6B) and a fixed position (position shown in FIG. 6A) to which the lever 40 is to be slid rearward (toward one side in the sliding direction) from the initial position. Furthermore, in a state in which the lever main body 41 is housed within the lever housing portion 32A, the lever main body 41 is arranged such that its upper end portion protrudes upward from the base 32. Furthermore, the feed dog base 34 is arranged on the upper side of the lever main body 41 such that they are adjacent to each other. With this, the feed dog base 34 restricts the upward movement of the lever main body 41 (lever 40).

A pair of left and right spring housing recess portions 41 are formed in the lever main body 41. Each spring housing recess portion 41A is configured in a recessed shape having an opening that faces the rear side. Each spring housing recess portion 41A houses a lever force-applying spring 50 configured as a "lever force-applying member". Each lever force-applying spring 50 is configured as a compression coil spring. Each lever force-applying spring 50 is arranged such that its rear end portion is engaged with the bottom face of the spring housing recess portion 41A, and such that its front end portion is engaged with the front face of the lever housing portion 32A of the base 32. With this, the lever 40 is forced toward the rear side by the lever force-applying spring 50.

Figure 7:
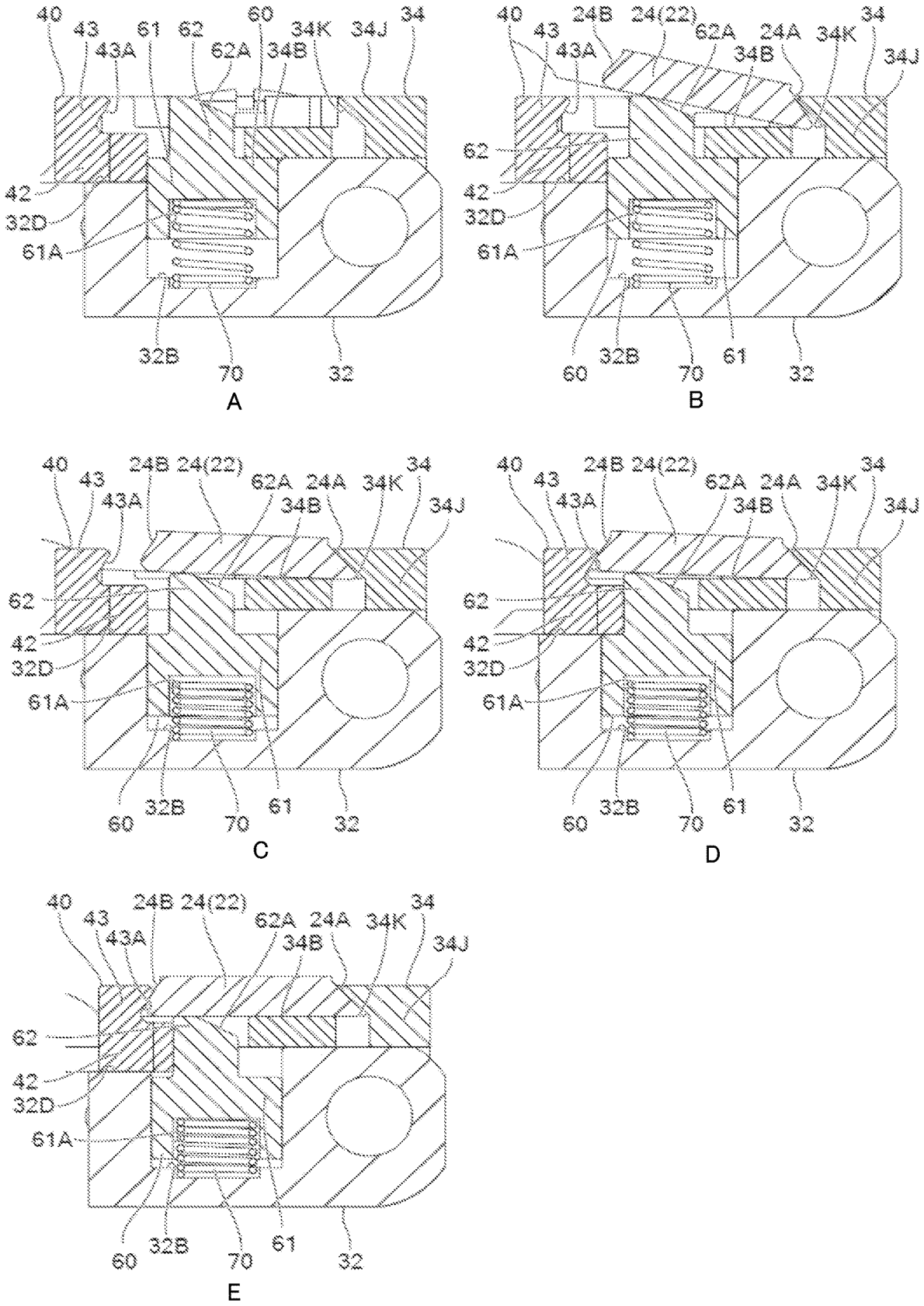
FIG. 7 is an explanatory diagram for explaining a procedure for mounting the feed dog shown in FIG. 3 on the feed base.

As shown in FIGS. 4 and 7, an arm portion 42 is provided to each of the respective side faces in the left-right direction of the lever main body 41. The arm portions 42 are configured such that they extend outward in the left-right direction from an upper-front end portion of the lever main body 41. Each arm portion 42 is arranged adjacent to the upper side of the step face 32D of the base 32. A lever-side fixing portion 43 configured as a "second fixing portion" is formed in a tip portion of each arm portion 42. The lever-side fixing portion 43 is configured such that it protrudes toward the upper side from each arm portion 42. Each lever-side fixing portion 43 is arranged on the front side of the feed dog base 34 and above the mounting face 34B of the feed dog base 34. Furthermore, each lever-side fixing portion 43 is arranged with a predetermined space on the front side of the above-described base-side fixing face 34K. Specifically, in the initial position of the lever 40, the distance between the base-side fixing portion 34J and the lever-side fixing portion 43 in the front-rear direction is designed to be longer than the length of the fixing target portion 24 of the feed dog 22 in the front-rear direction.

The rear face of the lever-side fixing portion 43 is configured as a lever-side fixing face 43A, which is configured as a "second fixing face". The lever-side fixing face 43A is configured to have a slope that is inclined upward in a linear manner as it becomes closer to the rear side in a side view. That is to say, the lever-side fixing face 43A is configured as a flat sloping face. With such an arrangement, in a state in which the feed dog 22 is fixedly mounted, the lever-side fixing face 43A comes in contact with the second fixing target face 24B of the feed dog 22 from the front side such that the lever 40 is arranged at a fixed position. With this, the lever-side fixing face 43A and the second fixing target face 24B are engaged with each other, thereby restricting the movement of the fixing target portion 24 toward the front side and the upper side in the fixed state. That is to say, with such an arrangement, the fixing target portion 24 is fixed such that it is interposed between the base-side fixing portion 34J and the lever-side fixing portion 43 in the front-rear direction by the force applied by the lever force-applying spring 50. Furthermore, in a side view, the slope angle of the lever-side fixing face 43A in the front-rear direction is designed to be slightly smaller than that of the second fixing target face 24B in the front-rear direction. Accordingly, in a state in which the second fixing target face 24B and the lever-side fixing face 43A come in contact with each other, such an arrangement provides line contact between them instead of plane contact. Specifically, such an arrangement is designed such that the upper end portion of the lever-side fixing face 43A comes in contact with the second fixing target face 24B.

Figure 5:
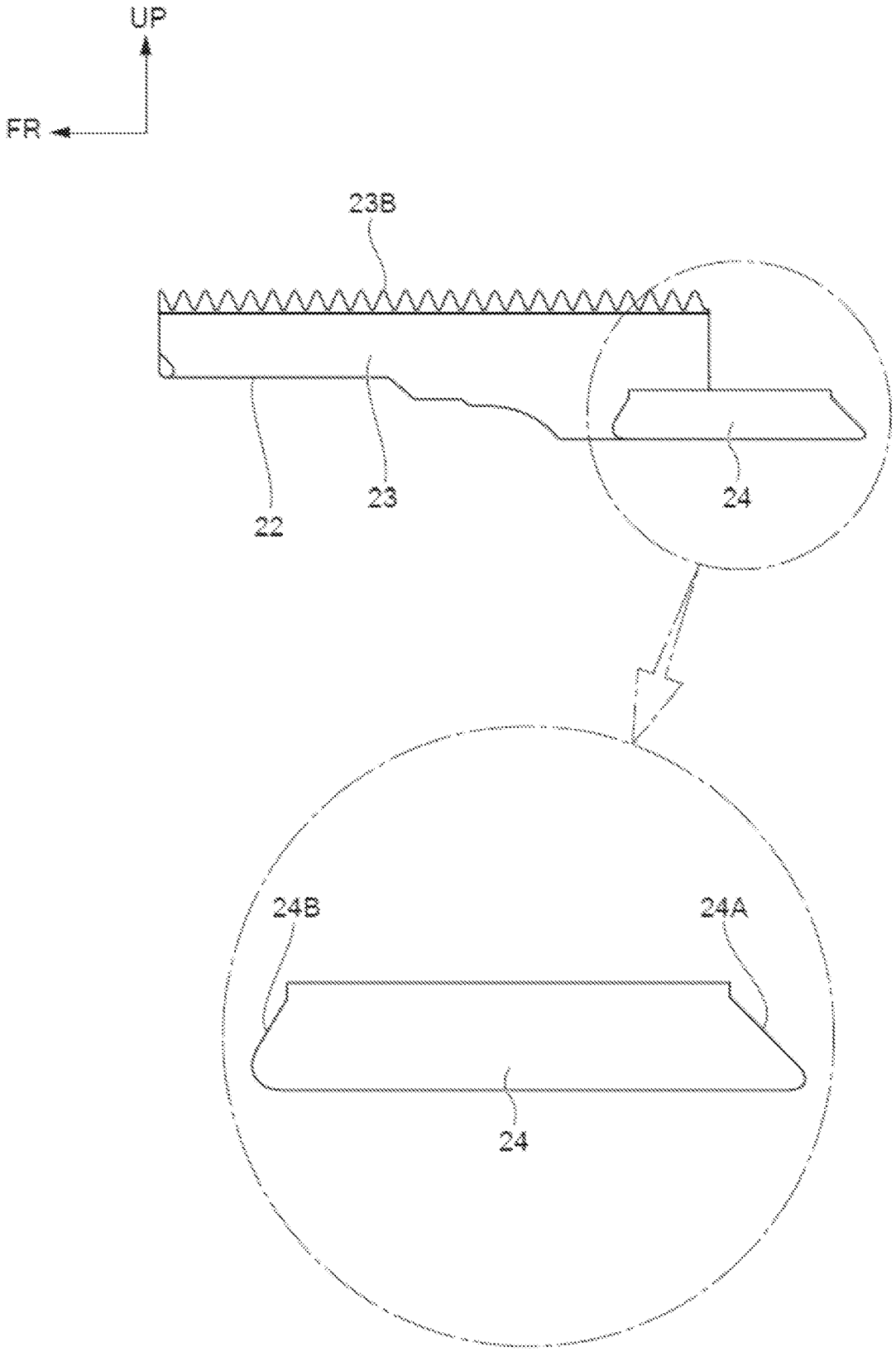
FIG. 5 is a side view showing the feed dog shown in FIG. 4 as viewed from the right side.

As shown in FIGS. 4 and 5, the lever-side holder portion 44 is provided to the upper face of the lever main body 41. The lever-side holder portion 44 is configured in an approximately rectangular block shape. The lever-side holder portion 44 is connected to a central portion in the left-right direction of the rear end portion of the lever main body 41. Furthermore, the lever-side holder portion 44 is configured such that it protrudes toward the rear side from the lever main body 41. The lever-side holder portion 44 is arranged such that it is inserted into the hole portion 34F of the feed dog base 34 and such that it is housed within the holder housing portion 34E of the feed dog base 34. The rear face of the lever-side holder portion 44 is configured as a lever-side holder face 44A. With this, when the lever 40 is set to the fixed position, the lever-side holder face 44A is arranged with a predetermined gap G on the front side with respect to the feed base-side holder face 34G of the feed dog base 34.

Regarding the Stopper 60

As shown in FIGS. 4 and 7, the stopper 60 includes a stopper main body 61. The stopper main body 61 is configured in an approximately rectangular block shape, and is housed within the stopper housing portion 32B of the base 32 such that it can be moved in the upper-lower direction. Specifically, the stopper 60 is configured such that it can be moved between a lever holding position (position shown in FIG. 7A) and a pressed position (position shown in FIG. 7E) to which the stopper 60 is to be moved downward from the lever holding position. Furthermore, when the stopper 60 is set to the lever holding position, the stopper main body 61 is arranged adjacent to the lower side of the feed dog base 34, thereby restricting the upward movement of the stopper main body 61.

A recess-shaped spring housing portion 61A having an opening that faces the lower side is formed in the lower face of the stopper main body 61. A stopper force-applying spring 70 configured as a "stopper force-applying member" is housed within the spring housing portion 61A. The stopper force-applying spring 70 is configured as a compression coil spring. The stopper force-applying spring 70 is arranged such that its upper end portion is engaged with the top face of the spring housing portion 61A, and such that its lower end portion is engaged with the bottom face of the stopper housing portion 32B. With this, the stopper 60 is forced upward by the force applied by the stopper force-applying spring 70.

With such an arrangement, before the feed dog 22 is mounted, the stopper 60 is arranged at the lever holding position. Furthermore, the upper end portion of the stopper main body 61 is arranged on the upper side of the step face 32D of the base 32. In this state, the front face of the upper-end portion of the stopper main body 61 is exposed toward the front side from the stopper housing portion 32B. Furthermore, when the stopper 60 is set to the lever holding position, the right-side arm portion 42 of the lever 40 comes in contact with the upper end portion of the stopper main body 61 from the front side. With this arrangement, the lever 40 is held at the initial position by the stopper 60.

Furthermore, a pressing target portion 62 is provided to the upper face of the stopper main body 61. The pressing target portion 62 is configured in an approximately rectangular columnar shape such that it protrudes toward the upper side from the stopper main body 61. A slope face 62A is formed in a rear portion of the upper face of the pressing target portion 62. The slope face 62A is configured to have a slope that is inclined toward the lower side as it becomes closer to the rear side in a side view.

With this, when the stopper 60 is set to the lever holding position, the upper end portion of the pressing target portion 62 is arranged such that it protrudes toward the upper side with respect to the mounting face 34B of the feed dog base 34. Furthermore, after the feed dog 22 is mounted on the feed dog base 34, the pressing target portion 62 is pressed downward by the lower face of the feed dog 22 so as to move the stopper 60 downward from the lever holding position. More specifically, with such an arrangement, when the feed dog 22 is mounted on the mounting face 34B, the stopper 60 is moved to the pressed position. Furthermore, when the stopper 60 is at a position before the pressed position, the contact state between the stopper main body 61 and the lever 40 is designed to be released. This allows the lever 40 to be slid rearward from the initial position.

Operation and Effects

Next, description will be made regarding the operation and effects of the present embodiment while explaining a procedure for mounting and unmounting of the feed dog 22 on the feed base 30.

Regarding a Procedure for Mounting the Feed Dog 22 on the Feed Base 30

Description will be made below with reference to FIG. 7 regarding a procedure for mounting the feed dog 22 on the feed base 30. It should be noted that FIG. 7 shows a procedure for mounting the feed dog 22 on the feed base 30 in chronological order.

Before the feed dog 22 is mounted on the feed base 30, the stopper 60 is forced upward by the stopper force-applying spring 70 such that it is set to the lever holding position. Furthermore, in this state, the lever 40 is held at the initial position. In addition, the arm portion 42 of the lever 40 is pressed in contact with the upper end portion of the stopper 60 by the force applied by the lever force-applying spring 50 (see FIG. 7A).

Subsequently, when the feed dog 22 is mounted on the feed base 30, the feed dog 22 is arranged on the upper side of the feed base 30 in a state in which it is tilted toward the rear side. In this state, the rear end portion of the fixing target portion 24 of the feed dog 22 is inserted into a space on the lower side of the base-side fixing face 34K of the feed dog base 34 (see FIG. 7B). Furthermore, the fixing target portion 24 of the feed dog 22 is arranged adjacent to the upper side of the pressing target portion 62 of the stopper 60.

In this state, the front end portion of the feed dog 22 is pressed downward. With this, the front end portion of the fixing target portion 24 of the feed dog 22 is displaced downward. In addition, the fixing target portion 24 presses the pressing target portion 62 of the stopper 60 downward. As a result, the stopper 60 is moved downward from the lever holding position against the force applied by the stopper force-applying spring 70 (see FIG. 7C). That is to say, the upper end portion of the stopper 60 is moved downward while sliding along the arm portion 42 of the lever 40.

Subsequently, before the stopper 60 is set to the pressed position, the contact state between the stopper 60 and the arm portion 42 of the lever 40 is released. Specifically, before the fixing target portion 24 of the feed dog 22 is mounted on the mounting face 34B of the feed dog base 34, the contact state between the stopper 60 and the arm portion 42 of the lever 40 is released. This allows the lever 40 to be slid from the initial position toward the rear side. Accordingly, the lever 40 is slid rearward due to the force applied by the lever force-applying spring 50. As a result, the lever-side fixing face 43A of the lever 40 comes in contact with the second fixing target face 24B of the fixing target portion 24 of the feed dog 22 (see FIG. 7D).

In this state, the feed dog 22 is further pressed downward. As a result, when the fixing target portion 24 is mounted on the mounting face 34B of the feed dog base 34, the stopper 60 is moved to the pressed portion. Furthermore, the lever 40 is further slid rearward, and is set to the fixed position. In this state, the fixing target portion 24 of the feed dog 22 is fixed to the feed base 30 in a state in which it is interposed between the lever-side fixing portion 43 of the lever 40 and the base-side fixing portion 34J of the feed dog base 34 in the front-rear direction (see FIG. 7E). Furthermore, in this state, the upper face of the stopper main body 61 of the stopper 60 is arranged with a gap below the arm portion 42 of the lever 40. Moreover, in this state, the restricting protrusion 34L of the feed dog base 34 is inserted into the restricting recess portion 23D of the feed dog 22.

Regarding a Procedure for Unmounting the Feed Dog 22 from the Feed Base 30

Figure 9:
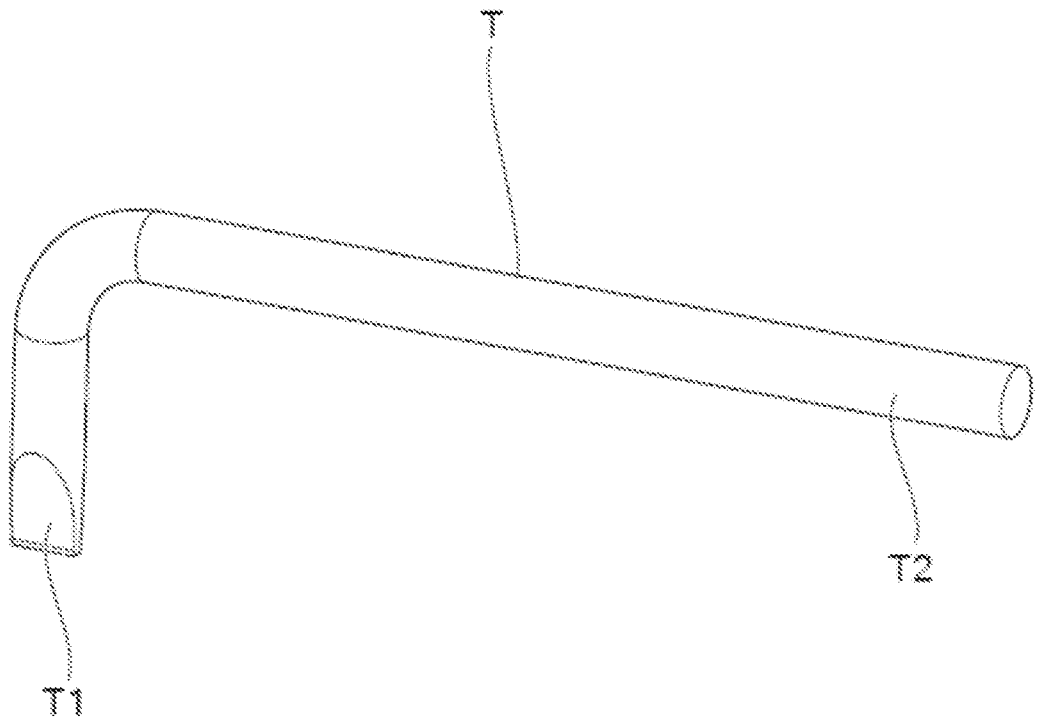
FIG. 9 is a perspective view showing a tool to be used to unmount the feed dog from the feed base in the feed dog mounting/unmounting mechanism according to the present embodiment.

When the feed dog 22 is to be unmounted from the feed base 30, the feed dog 22 is unmounted from the feed base 30 using an unmounting tool T. Accordingly, first, description will be made regarding a configuration of the unmounting tool T. As shown in FIG. 9, the unmounting tool T is configured in a longitudinal rod shape having an approximately L-shaped bent portion. The unmounting tool T is configured such that its one end is configured as a bit portion T1 having a flat-blade cross-sectional shape, and such that the other end thereof is configured as a grip portion T2 to be held by the user. It should be noted that, instead of such a unmounting tool T, the user may unmount the feed dog 22 from the feed base 30 using another tool such as a flat-head screwdriver or the like.

Figure 8:
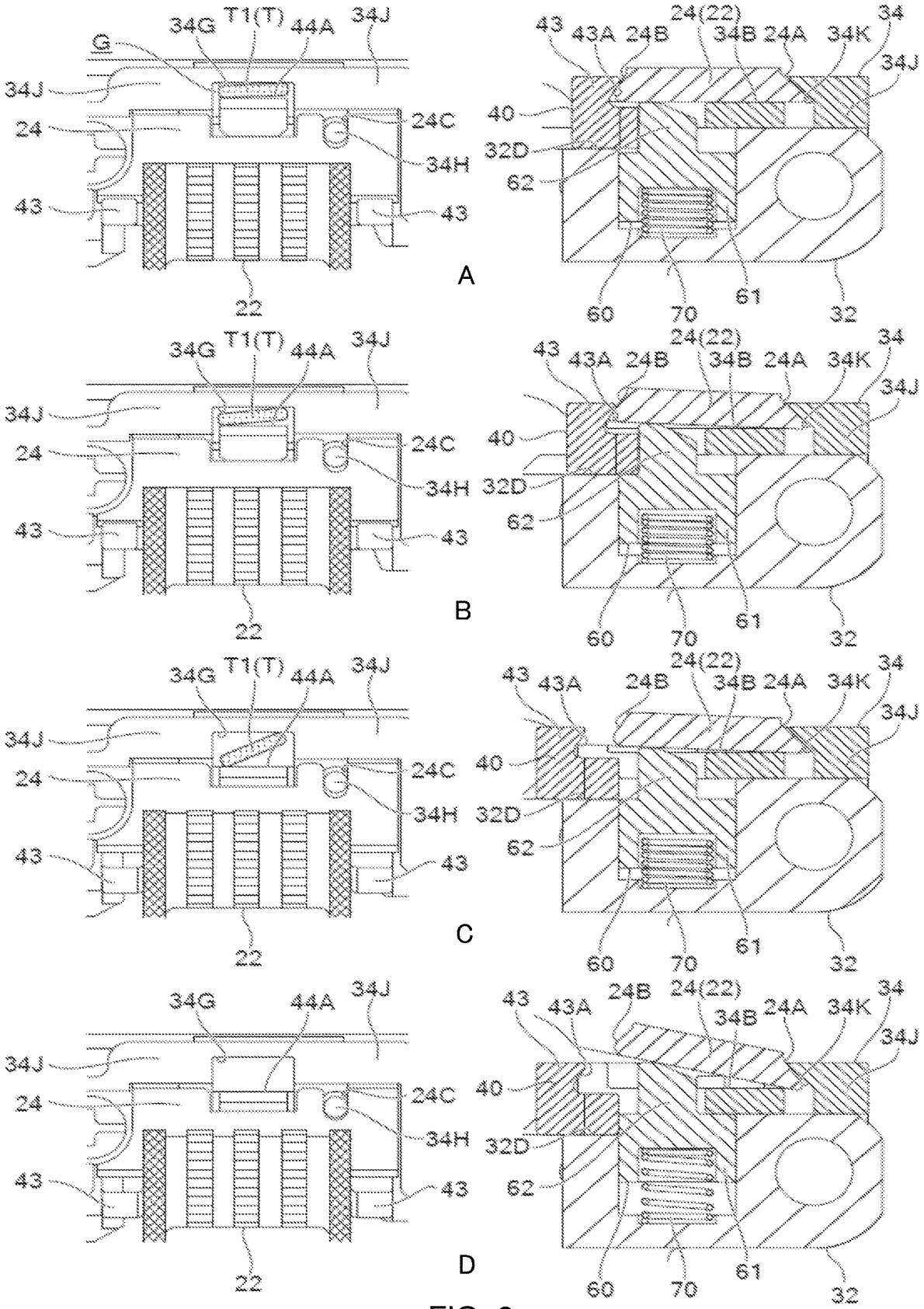
FIG. 8 is an explanatory diagram for explaining a procedure for unmounting the feed dog shown in FIG. 3 from the feed base.

Next, description will be made with reference to FIG. 8 regarding a procedure for unmounting the feed dog 22 from the feed base 30. It should be noted that FIG. 8 shows a procedure for unmounting the feed dog 22 from the feed base 30 in chronological order. In FIG. 8, the diagrams shown on the left side each show a plan view of a portion around the rear end portion of the feed dog mounting/unmounting mechanism 20. The diagrams shown on the right side each show a plan view of a portion around the stopper 60 of the feed dog mounting/unmounting mechanism 20, which corresponds to the drawing shown on the left side.

In a state in which the feed dog 22 is mounted on the feed base 30, the lever-side holder face 44A of the lever-side holder portion 44 of the lever 40 is arranged with a predetermined gap G on the front side of the feed base-side holder face 34G of the feed dog base 34. When the feed dog 22 is to be unmounted from the feed base 30, the bit portion T1 of the unmounting tool T is inserted into the gap G between the lever-side holder face 44A and the feed base-side holder face 34G (see FIG. 8A).

In this state, the bit portion T1 of the unmounting tool T is rotated (see FIG. 8B). FIG. 8B shows an example in which the bit portion T1 is rotated in a counterclockwise manner. Upon rotating the bit portion T1 of the unmounting tool T, one end of the bit portion T1 is pressed in contact with the feed base-side holder face 34G of the feed dog base 34. Furthermore, the other end of the bit portion T1 is pressed into contact with the lever-side holder face 44A of the lever 40. This presses the lever-side holder portion 44 frontward. That is to say, the lever-side holder portion 44 is pressed frontward by the bit portion T1 of the unmounting tool T using the principle of leverage. With this, the lever 40 is slid frontward from the fixed position against the force applied by the lever force-applying spring 50.

When the lever 40 is slid frontward from the fixed position, the lever-side fixing face 43A of the lever 40 is relatively moved frontward with respect to the second fixing target face 24B of the feed dog 22. Furthermore, the pressing target portion 62 of the stopper 60 is arranged below the fixing target portion 24 of the feed dog 22. In this state, the stopper 60 is forced upward by the stopper force-applying spring 70. Accordingly, upon sliding the lever 40 frontward from the fixed position, the pressing target portion 62 of the stopper 60 presses the fixing target portion 24 of the feed dog 22 upward, thereby displacing the lower face of the fixing target portion 24 upward away from the mounting face 34B of the feed dog base 34. Specifically, the feed dog 22 is lifted up such that it is tilted toward the rear side in a state in which the second fixing target face 24B of the feed dog 22 is in contact with the lever-side fixing face 43A of the lever 40 and the first fixing target face 24A of the feed dog 22 is in contact with the base-side fixing face 34K of the feed dog base 34.

Upon further rotating the bit portion T1 of the unmounting tool T in the state shown in FIG. 8B, the lever 40 is further slid frontward. In addition, this releases the contact state between the lever-side fixing face 43A of the lever 40 and the second fixing target face 24B of the fixing target portion 24 of the feed dog 22 (see FIG. 8C).

Subsequently, when the lever 40 has been slid partway up to the initial position, the stopper 60 is moved upward by the force applied by the stopper force-applying spring 70, and is set to the lever holding position. With this, the fixing target portion 24 of the feed dog 22 is pressed upward by the pressing target portion 62 of the stopper 60, thereby unmounting the feed dog 22 from the feed base 30. Furthermore, in this stage, the upper end portion of the stopper main body 61 of the stopper 60 is arranged adjacent to the rear side of the arm portion 42 of the lever 40. With this, the lever 40 is held at the initial position by the stopper main body 61 (see FIG. 8D).

As described above, in the feed dog mounting/unmounting mechanism 20, the lever 40 is provided on the feed base 30 such that it can be slid in the front-rear direction. Furthermore, the lever 40 is forced rearward by the lever force-applying spring 50. With this, upon sliding the lever 40 rearward from the initial position, the fixing target portion 24 of the feed dog 22 is fixed in a state in which it is interposed between the base-side fixing portion 34J of the feed base 30 and the lever-side fixing portion 43 of the lever 40 in the front-rear direction.

Here, the feed base 30 is provided with the stopper 60 configured such that it can be moved in the upper-lower direction. The lever 40 is held at the initial position by the stopper 60. With this, when the feed dog 22 is mounted on the feed base 30, the stopper 60 is pressed downward by the feed dog 22. This moves the stopper 60 so as to allow the lever 40 to slide from the initial position. With this, the lever 40 is slid from the initial position to the fixed position by the force applied by the lever force-applying spring 50 so as to fix the fixing target portion 24 such that it is interposed between the base-side fixing portion 34J and the lever-side fixing portion 43. Accordingly, the fixing target portion 24 can be fixed between the base-side fixing portion 34J and the lever-side fixing portion 43 without a need to slide the lever 40 frontward against the force applied by the lever force-applying spring 50. That is to say, such an arrangement allows the feed dog 22 to be mounted on the feed base 30 without being affected by the force applied by the lever force-applying spring 50. Accordingly, such an arrangement provides improved operating efficiency in the mounting of the feed dog 22.

Furthermore, the stopper 60 is configured such that it can be moved between the lever holding position at which the lever 40 is held at the initial position and the pressed position at which the lever 40 is pressed downward from the lever holding position by the feed dog 22. Moreover, the stopper force-applying spring 70 is provided to the base plate of the feed base 30. The stopper force-applying spring 70 applies force to the stopper 60 toward the lever holding position side. Accordingly, when the feed dog 22 is to be unmounted from the feed base 30, the lever 40 is slid from the fixed position to the initial position so as to release the holding state in which the fixing target portion 24 is held by the base-side fixing portion 34J and the lever-side fixing portion 43. This allows the feed base 30 to be pressed upward by the stopper 60. This provides improved operating efficiency in the unmounting of the feed dog 22 from the feed base 30.

Furthermore, the lever-side holder portion 44 of the lever 40 is housed within the holder housing portion 34E of the feed dog base 34. In this state, the lever-side holder face 44A of the lever-side holder portion 44 is arranged on the front side of the feed base-side holder face 34G of the holder housing portion 34E so as to form the gap G between the lever-side holder face 44A and the feed base-side holder face 34G. This allows the bit portion T1 of the unmounting tool T to be inserted into the gap G between the lever-side holder face 44A and the feed base-side holder face 34G, so as to slide the lever 40 from the fixed position to the initial position using the unmount tool T. This provides improved operating efficiency in the unmounting of the feed dog 22 from the feed base 30.

Furthermore, the feed base 30 is configured including the base 32 that forms a lower portion of the feed base 30 and the feed dog base 34 that forms an upper portion of the feed base 30. Moreover, the lever 40 is provided such that it can be slid between the base 32 and the feed dog base 34. The feed dog 22 is mounted on the feed dog housing portion 34A of the feed dog base 34 from the upper side. With such a simple configuration, the lever 40 can be slidably provided on the feed base 30. Furthermore, the feed dog 22 can be mounted on the feed base 30 coupled to the lever 40.

Furthermore, the stopper housing portion 32B is formed in the base 32 such that it has an opening that faces the upper side. With this arrangement, the stopper main body 61 of the stopper 60 and the stopper force-applying spring 70 are housed in the stopper housing portion 32B. With such an arrangement, when the stopper 60 is set to the lever holding position, the stopper 60 is arranged such that the upper end portion of the stopper main body 61 thereof protrudes toward the upper side from the stopper housing portion 32B and is in contact with the arm portion 42 of the lever 40 at the initial position. This allows the lever 40 to be held at the initial position in a simple manner. Furthermore, by housing the stopper main body 61 within the stopper housing portion 32B, the contact state between the lever 40 and the stopper 60 can be released, thereby allowing the lever 40 to be slid from the initial position.

Furthermore, the base-side fixing portion 34J of the feed dog base 34 has the base-side fixing face 34K. The base-side fixing face 34K is formed such that it has a slope inclined upward as it becomes closer to the front side. Moreover, the lever-side fixing portion 43 of the lever 40 has the lever-side fixing face 43A. The lever-side fixing face 43A is configured to have a slope that is inclined upward as it becomes closer to the rear side. With such an arrangement, the fixing target portion 24 of the feed dog 22 is held by the base-side fixing face 34K and the lever-side fixing face 43A such that it is interposed between them in the front-rear direction. This allows the movement of the fixing target portion 24 to be restricted in the front-rear direction and the upper-lower direction.

Furthermore, the first fixing target face 24A of the fixing target portion 24 of the feed dog 22 is configured to have a slope that is inclined upward as it becomes closer to the front side corresponding to the base-side fixing face 34K. Moreover, the second fixing target face 24B of the fixing target portion 24 is configured to have a slope that is inclined upward as it becomes closer to the rear side corresponding to the lever-side fixing face 43A. Accordingly, by designing the slope angles of the first fixing target face 24A and the second fixing target face 24B as appropriate, such an arrangement allows the first fixing target face 24A and the base-side fixing face 34K to be set to a line contact state, and allows the second fixing target face 24B and the lever-side fixing face 43A to be set to a line contact state. This allows the contact portion between the first fixing target face 24A (second fixing target face 24B) and the base-side fixing face 34K (lever-side fixing face 43A) to be designed with high precision. Accordingly, such an arrangement provides an improved fixing state for the fixing target portion 24.

Figure 10A:
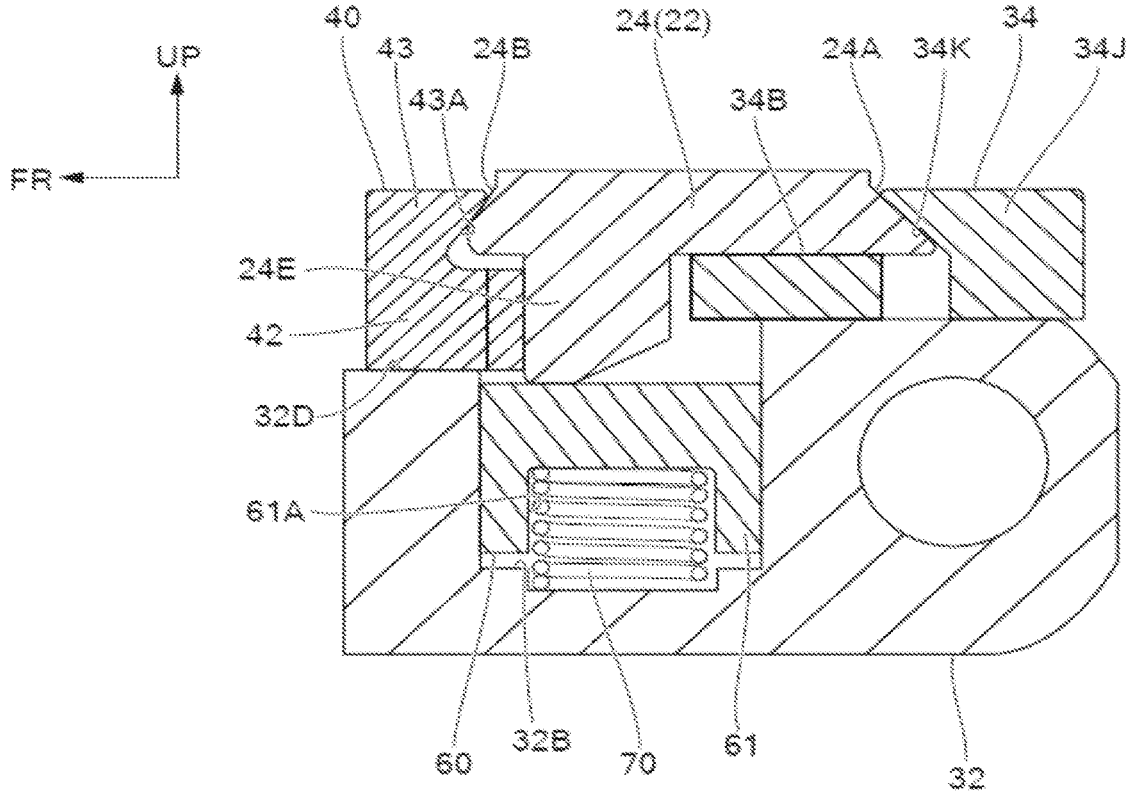
FIG. 10A is a cross-sectional diagram showing a modification of the feed dog and the stopper shown in FIG. 4 as viewed from the right side.
Figure 10B:
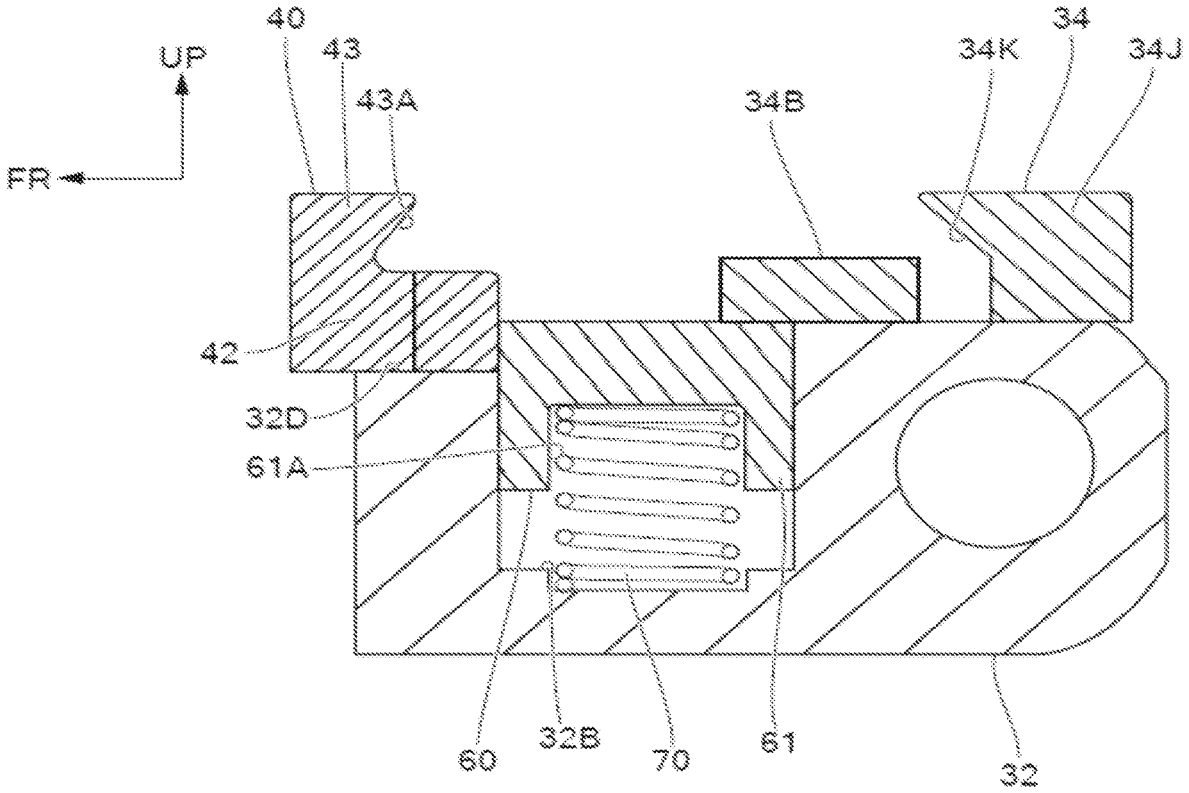
FIG. 10B is a cross-sectional diagram showing a state shown in FIG. 10A in which the feed dog is unmounted from the feed base.

It should be noted that, in the present embodiment, the stopper 60 is configured including the stopper main body 61 and the pressing target portion 62 formed such that it protrudes toward the upper side from the stopper main body 61. However, as shown in FIGS. 10A and 10B, the pressing target portion 62 may be omitted in the stopper 60. In this case, a protrusion portion 24E may be formed in the fixing target portion 24 of the feed dog 22. The protrusion portion 24E is configured in a shape that is the reverse of that of the pressing target portion 62 in the upper-lower direction in a side view such that it protrudes toward the lower side from the fixing target portion 24. With such an arrangement, when the feed dog 22 is to be mounted on the feed base 30, the stopper main body 61 of the stopper 60 is pressed downward by the protrusion portion 24E. With this arrangement, after the feed dog 22 is unmounted from the feed base 30, the stopper 60 is arranged such that it does not protrude toward the upper side with respect to the mounting face 34B of the feed base 34. Accordingly, such an arrangement suppresses a situation in which the stopper 60 is inadvertently pressed downward in a state in which the feed dog 22 is unmounted from the feed base 30. As a result, such an arrangement is capable of suppressing a situation in which the lever 40 is slid to the fixed position in a state in which the feed dog 22 is unmounted from the feed base 30.

Figure 11A:
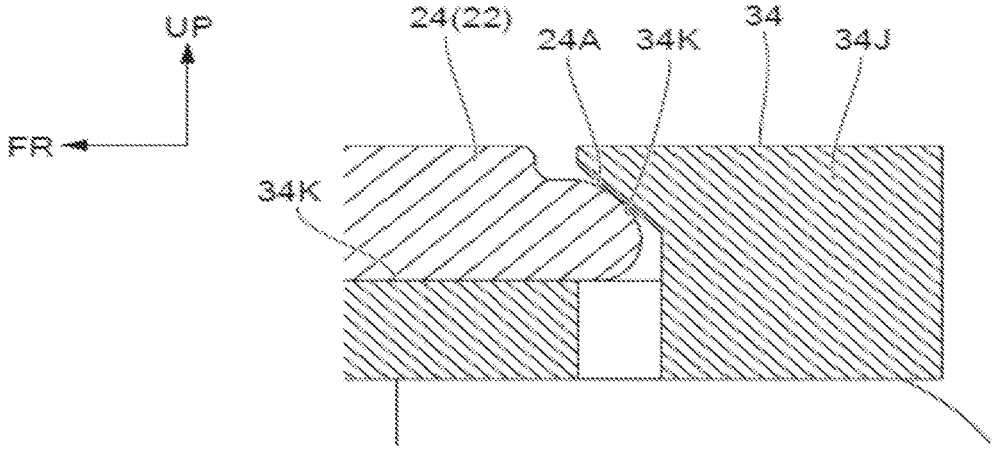
FIG. 11A is a cross-sectional diagram showing a modification of the first fixing target face shown in FIG. 7.

Furthermore, in the present embodiment, the first fixing target face 24A of the feed dog 22 and the base-side fixing face 34K of the feed dog base 34 are each configured as a flat sloping face. Furthermore, the second fixing target face 24B of the feed dog 22 and the lever-side fixing face 43A of the lever 40 are each configured as a flat sloping face. Instead of such an arrangement, at least one from among the first fixing target face 24A and the base-side fixing face 34K may be configured as a curved slope face. Also, at least one from among the second fixing target face 24B and the lever-side fixing face 43A may be configured as a curved slope face. For example, as shown in FIG. 11A, the first fixing target face 24A may be configured as a curved face that protrudes toward the base-side fixing face 34K. In this case, such an arrangement also allows the first fixing target face 24A and the base-side fixing face 34K to be set to a line contact state, and also allows the second fixing target face 24B and the lever-side fixing face 43A to be set to a line contact state.

Description has been made in the present embodiment regarding an arrangement in which the second fixing target face 24B of the feed dog 22 and the lever-side fixing face 43A of the lever 40 are arranged such that they are in contact with each other so as to restrict the front end portion of the fixing target portion 24 from moving upward. Also, a restricting portion may be formed in the lever-side fixing portion 43 of the lever 40 for restricting the upward movement of the fixing target portion 24.

Figure 11B:
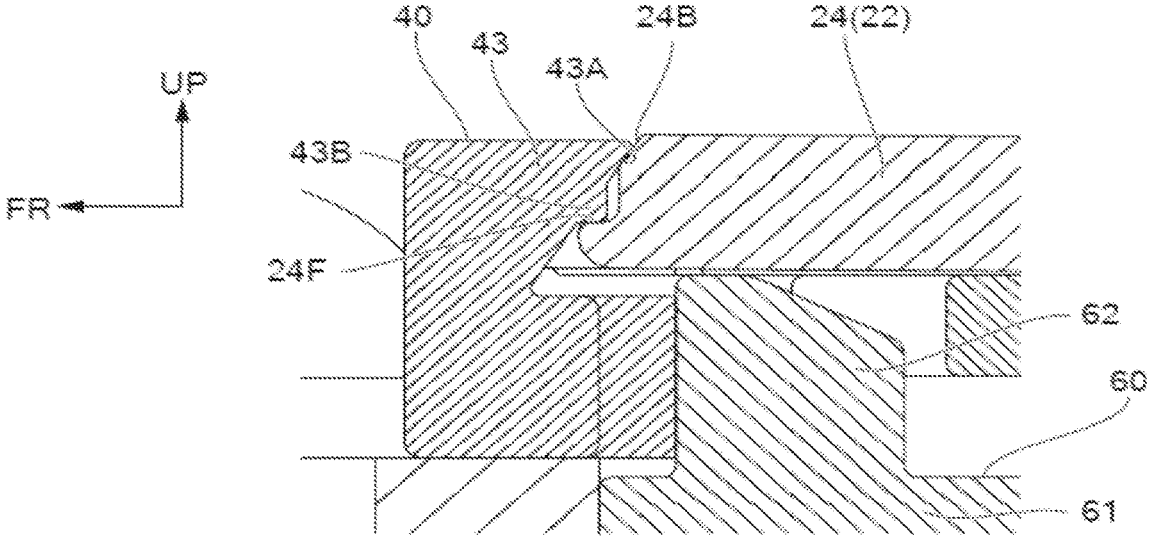
FIG. 11B is a cross-sectional diagram showing another modification of the lever-side fixing portion shown in FIG. 7.

For example, as shown in FIG. 11B, a restricting portion 43B is formed in the lever-side fixing face 43A of the lever 40 such that it protrudes toward the rear side and such that its lower face is orthogonal to the upper-lower direction. On the other hand, an engagement recess portion 24F is formed in the second fixing target face 24B of the feed dog 22 such that it has an opening that faces the upper side and the front side and such that its bottom face is orthogonal to the upper lower direction. With such an arrangement, the engagement recess portion 24F is arranged adjacent to the lower side of the restricting portion 43B, thereby engaging the restricting portion 43B and the engagement recess portion 24F in the upper-lower direction. With this, the upward movement of the fixing target portion 24 is effectively restricted, thereby allowing the feed dog 22 to be satisfactorily maintained in a fixed state.

Figure 11C:
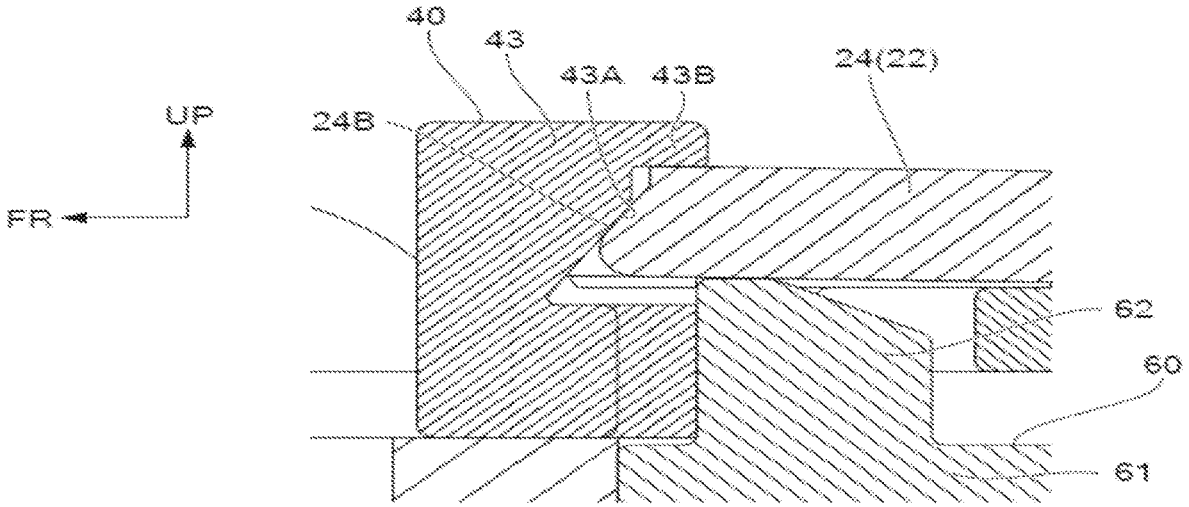
FIG. 11C is a cross-sectional diagram showing yet another modification of the lever-side fixing portion shown in FIG. 7.

Also, for example, as shown in FIG. 11C, a restricting portion 43B is formed in the upper end portion of the lever-side fixing portion 43 of the lever 40 such that it protrudes toward the rear side and such that its lower face is orthogonal to the upper-lower direction. With such an arrangement, the front end portion of the fixing target portion 24 is arranged adjacent to the lower side of the restricting portion 43B, thereby engaging the restricting portion 43B and the front end portion of the fixing target portion 24 in the upper-lower direction. With this, the upward movement of the fixing target portion 24 is effectively restricted, thereby allowing the feed dog 22 to be satisfactorily maintained in a fixed state.

Figure 12:
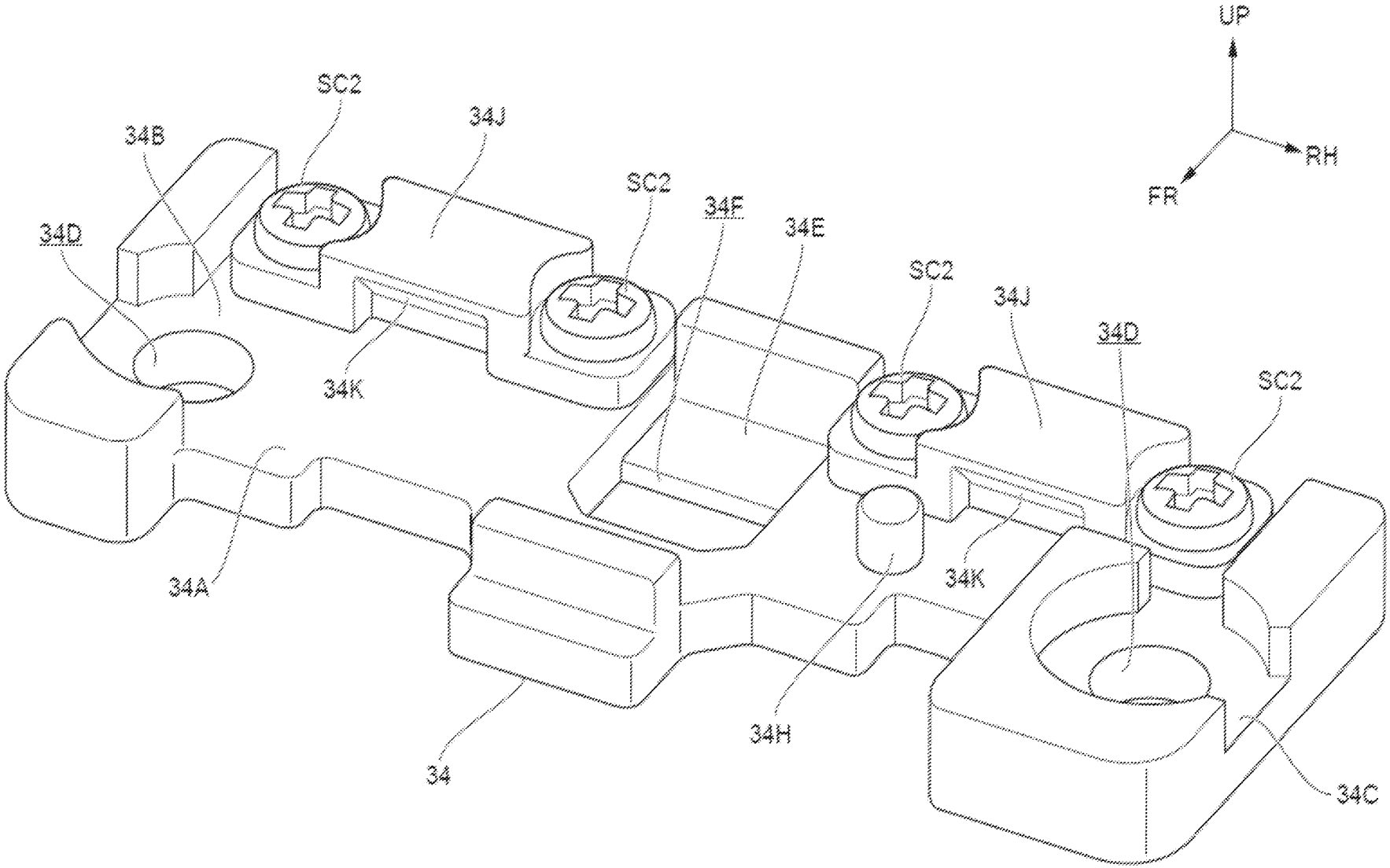
FIG. 12 is a perspective diagram showing a modification of the feed dog base shown in FIG. 4 as viewed from the diagonally right-front side.

Description has been made in the present embodiment regarding an arrangement in which the base-side fixing portion 34J is monolithically formed in the feed dog base 34. Also, as shown in FIG. 12, the feed dog base 34 and the base-side fixing portion 34J may be formed as separate components. Also, the base-side fixing portion 34J may be fixedly mounted on the feed dog base 34 by screws SC2, so as to provide the base-side fixing portion 34J integrally with the feed dog base 34. This enables fine adjustment of the position of the base-side fixing portion 34J in the front-rear direction. That is to say, this arrangement enables fine adjustment of the distance between the base-side fixing portion 34J and the restricting protrusion 34L in the front-rear direction. In other words, this arrangement enables fine adjustment of the position of the base-side fixing portion 34J so as to eliminate a gap between the rear face of the restricting protrusion 34L of the feed dog base 34 and the rear face of the restricting recess portion 23D of the feed dog 22. As a result, such an arrangement is capable of suppressing the occurrence of rattling in the feed dog 22 even if an external force is applied to the feed dog 22 downward.

Figure 13A:
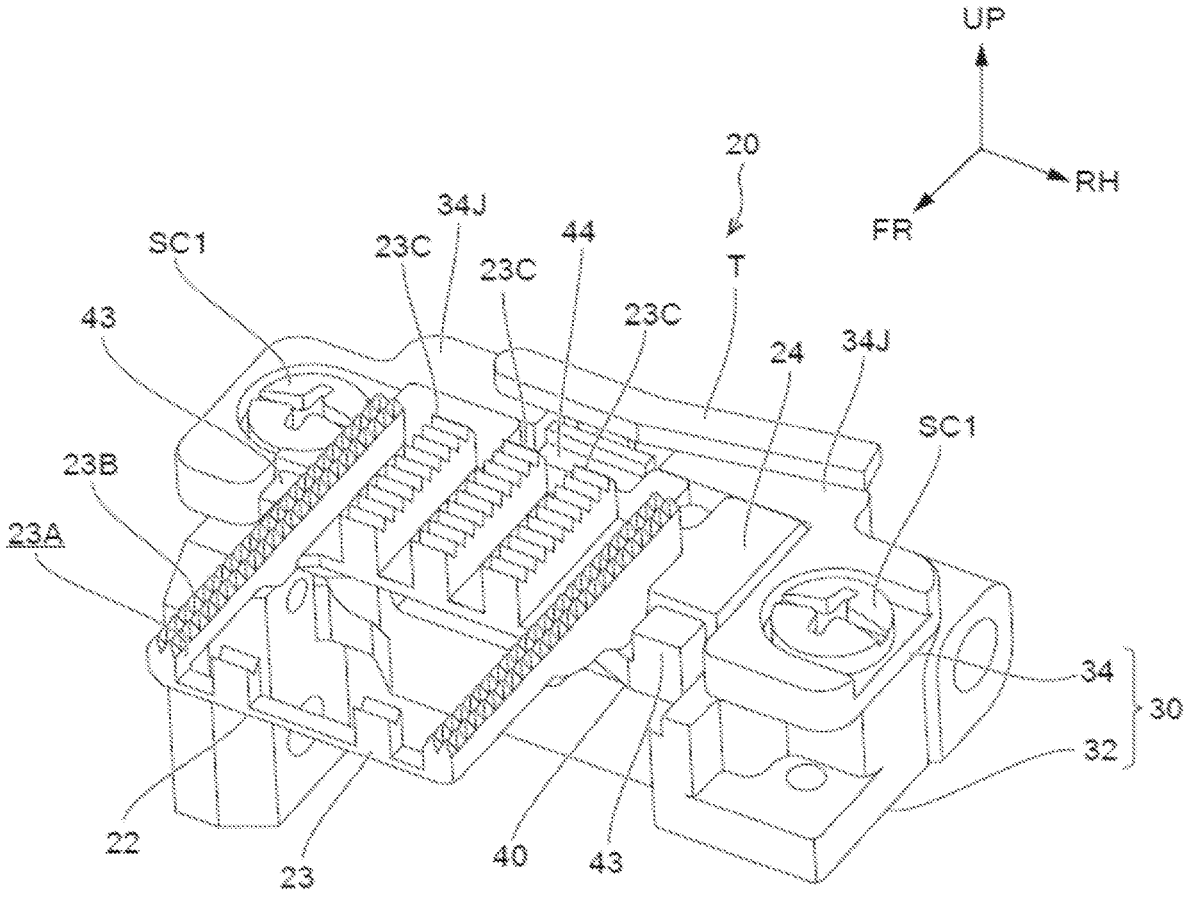
FIG. 13A is a perspective diagram showing an example in which a tool to be used for unmounting the feed dog from the feed dog base is attached to the feed dog base.
Figure 13B:
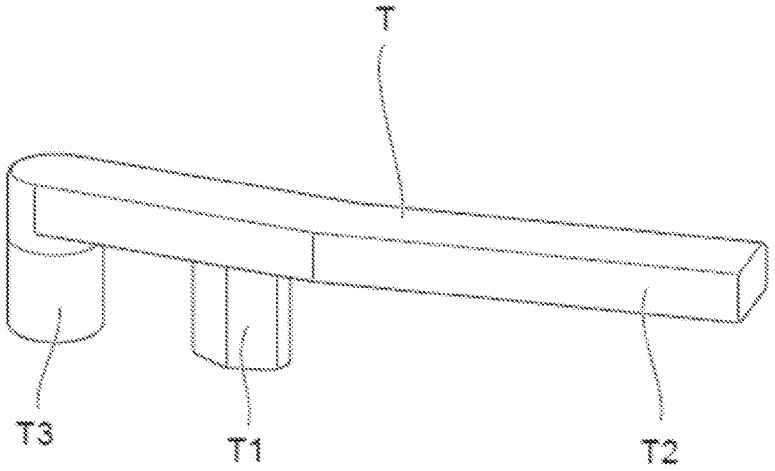
FIG. 13B is a perspective view showing the tool shown in FIG. 13A.

Also, in the present embodiment, the unmounting tool T may be provided to the feed dog mounting/unmounting mechanism 20. For example, as shown in FIGS. 13A and 13B, a rotational shaft T3 is provided to one end of the unmounting tool T having a longitudinal rod shape. The rotational shaft T3 is formed such that it extends in a direction that is orthogonal to the direction in which the unmounting tool T extends. Furthermore, the bit portion T1 is provided to one end side portion of the unmounting tool T such that it extends in parallel with the rotational shaft T3. With such an arrangement, the rotational shaft T3 is rotationally coupled to the feed dog base 34 with the axial direction of the rotational shaft T3 as the upper-lower direction. Furthermore, the bit portion T1 is inserted into the gap G. With this, upon rotating the unmounting tool T around the axis of the rotational shaft T3, the lever 40 at the fixed position is slid frontward, thereby allowing the feed dog 22 to be unmounted from the feed base 30. Accordingly, such an arrangement provides improved user convenience.

Description has been made in the present embodiment regarding an arrangement in which the unmounting tool T is used to unmount the feed dog 22 from the feed base 30. Also, the feed dog 22 may be unmounted from the feed base 30 without using the unmounting tool T. That is to say, the user may press the lever-side holder portion 44 of the lever 40 frontward with a finger so as to slide the lever 40 at the fixed position frontward.

DESCRIPTION OF THE REFERENCE NUMERALS

10 sewing machine, 20 feed dog mounting/unmounting mechanism, 22 feed dog, 23 feed dog main body portion (main body portion), 24 fixing target portion, 24E protrusion portion, 30 feed base, 32 base (feed base main body), 32B stopper housing portion, 34 feed dog base, 34G feed base-side holder face, 34J base-side fixing portion (first fixing portion), 34K base-side fixing face (first fixing face), 40 lever, 43 lever-side fixing portion (second fixing portion), 43A lever-side fixing face (second fixing face), 44A lever-side holder face, 50 lever force-applying spring (lever force-applying member), 60 stopper, 70 stopper force-applying spring (stopper force-applying member), G gap (gap between lever-side holder face and feed base-side holder face).

What is claimed is:

1. A feed dog mounting/unmounting mechanism comprising:

a feed base configured to perform a feeding operation;

a feed dog detachably mounted on the feed base and having a fixing target portion;

a first fixing portion arranged on the feed base and configured to fix the fixing target portion;

a lever slidably provided on the feed base and having a second fixing portion configured such that, when the lever is slid toward one side in a sliding direction from an initial position so as to be set to a fixed position, the fixing target portion is fixedly held such that it is interposed between the first fixing portion and the second fixing portion;

a lever force-applying member configured to apply a force to the lever toward one direction side in the sliding direction; and a stopper movably provided on the feed base and configured to hold the lever at the initial position and such that, when it is pressed downward by the feed dog when the feed dog is mounted, the stopper is moved so as to allow the lever to slide.

2. The feed dog mounting/unmounting mechanism according to claim 1, wherein the stopper is configured such that it can be moved between a lever holding position at which the lever is held at the initial position and a pressed position at which the stopper is pressed by the feed dog, wherein the feed base is provided with a stopper force-applying member, and wherein the stopper force-applying member applies a force to the stopper toward the lever holding position side.

3. The feed dog mounting/unmounting mechanism according to claim 2, wherein a lever-side holder face is formed in the lever, wherein a feed base-side holder face is formed in the feed base such that it faces the lever-side holder face in the sliding direction, and wherein a gap is formed between the lever-side holder face and the feed base-side holder face at the fixed position.

4. The feed dog mounting/unmounting mechanism according to claim 2, wherein the feed base is configured comprising:

a feed base main body that forms a lower portion of the feed base; and a feed dog base that forms an upper portion of the feed base, and that is provided with the first fixing portion, wherein the lever is slidably provided between the feed base main body and the feed dog base, and wherein the feed dog is mounted on the feed dog base from an upper side.

5. The feed dog mounting/unmounting mechanism according to claim 4, wherein a stopper housing portion having an opening that faces an upper side is formed in the feed dog main body for housing the stopper and the stopper force-applying member, and wherein, when the stopper is set to the lever holding position, a part of the stopper is arranged such that it protrudes toward an upper side from the stopper housing portion and such that it is in contact with the lever at the initial position.

6. The feed dog mounting/unmounting mechanism according to claim 4, wherein the first fixing portion has a first fixing face that is inclined upward as it becomes closer to the other side in the sliding direction of the lever, wherein the second fixing portion has a second fixing face that is inclined upward as it becomes closer to the one side in the sliding direction of the lever, and wherein the feed dog is held such that it is interposed between the first fixing face and the second fixing face.

7. The feed dog mounting/unmounting mechanism according to claim 4, wherein the feed dog is configured comprising:

a main body portion to be mounted on the feed dog base; and a protrusion portion configured such that it protrudes toward a lower side from the main body portion and such that it presses the stopper downward when the feed dog is mounted.

8. A sewing machine comprising the feed dog mounting/unmounting mechanism according to claim 1.

* * * * *